US011383804B2

(12) United States Patent
Taylor et al.

(10) Patent No.: US 11,383,804 B2
(45) Date of Patent: Jul. 12, 2022

(54) SHIPLIFT PLATFORM ELEVATION

(71) Applicant: Bardex Corporation, Goleta, CA (US)

(72) Inventors: Robert Taylor, Santa Barbara, CA (US); Daniel Lyons, Lompoc, CA (US)

(73) Assignee: Bardex Corporation, Goleta, CA (US)

( * ) Notice: Subject to any disclaimer, the term of this patent is extended or adjusted under 35 U.S.C. 154(b) by 0 days.

(21) Appl. No.: 17/015,352

(22) Filed: Sep. 9, 2020

(65) Prior Publication Data

US 2021/0070408 A1 Mar. 11, 2021

Related U.S. Application Data

(60) Provisional application No. 62/897,696, filed on Sep. 9, 2019.

(51) Int. Cl.
*B63C 3/06* (2006.01)
*B63C 3/12* (2006.01)

(52) U.S. Cl.
CPC . *B63C 3/06* (2013.01); *B63C 3/12* (2013.01)

(58) Field of Classification Search
CPC ..... E02C 5/00; B63B 2737/00; B66F 9/08
See application file for complete search history.

(56) References Cited

U.S. PATENT DOCUMENTS

| | | | | |
|---|---|---|---|---|
| 2,120,792 | A | 6/1938 | Yanney | |
| 3,252,589 | A * | 5/1966 | Keene | B63C 3/06 414/560 |
| 3,276,211 | A | 10/1966 | Drake | |
| 3,640,503 | A | 2/1972 | Spannlang | |
| 3,858,847 | A | 1/1975 | Chambers | |
| 3,902,616 | A | 9/1975 | Santic et al. | |
| 3,918,366 | A | 11/1975 | Noah | |
| 3,978,676 | A | 9/1976 | Chambers et al. | |
| 4,175,644 | A | 11/1979 | Sikli | |
| 5,076,450 | A | 12/1991 | Shimizu | |
| 5,314,263 | A | 5/1994 | Stokoe et al. | |
| 5,378,082 | A | 1/1995 | Hiller et al. | |
| 6,279,488 | B1 | 8/2001 | Hachmann et al. | |
| 9,226,440 | B2 | 1/2016 | Bassett | |
| 10,272,973 | B2 | 4/2019 | O'Rourke | |
| 2011/0101295 | A1 | 5/2011 | Hernandez | |
| 2015/0028787 | A1 | 1/2015 | Sekine et al. | |
| 2019/0106184 | A1 | 4/2019 | Taylor | |
| 2019/0263488 | A1 | 8/2019 | Taylor et al. | |

FOREIGN PATENT DOCUMENTS

| | | |
|---|---|---|
| EP | 1512654 A1 | 3/2005 |

OTHER PUBLICATIONS

International Search Report and Written Opinion issued in PCT Application No. PCT/US20/49839, dated Nov. 27, 2020 [11 pages].

* cited by examiner

*Primary Examiner* — Sean D Andrish
(74) *Attorney, Agent, or Firm* — Michael S. McCoy; Amatong McCoy LLC

(57) ABSTRACT

A shipyard including a shiplift platform that is capable of being raised above yard level for maintenance is provided. Hoists are coupled with the shiplift platform, and jacks are coupled with the hoists. The jacks are capable of lifting the hoists relative to the yard, and are capable of lifting the shiplift platform above the yard level.

22 Claims, 12 Drawing Sheets

SHIPLIFT PLATFORM ELEVATION

CROSS-REFERENCE TO RELATED APPLICATIONS

The present application claims the benefit of U.S. Provisional Patent Application No. 62/897,696, filed on Sep. 9, 2019, the entirety of which is incorporated herein by reference.

FIELD

The present disclosure relates to systems for lifting a shiplift platform above the level of a shipyard, to shiplift platforms including such systems, to shipyards including such systems, and to methods of making and using the same.

BACKGROUND

Shiplifts are used to dry dock and launch ships. Shiplifts typically include a structural platform that is lifted and lowered by hoists. Existing shiplift platform designs typically have arms that reach underneath piers on either side of the platform so that the hoists (e.g., chain jacks or winches) can be connected to the shiplift platform structure via chains or wire ropes. These hoists operate to lift and lower the shiplift platform, with or without a ship on it. Typically, the shiplift platform is lowered underwater, a ship is floated above the shiplift platform, and the shiplift platform and ship are then lifted above water-level using the hoists.

Shiplift platforms periodically require maintenance, such as re-painting (e.g., every 10 years or so). However, it is difficult to access at least some portions of shiplift platforms (e.g., the bottoms of shiplift platforms) for such maintenance because of the position of the shiplift platforms relative to the shipyard and/or the water-level.

BRIEF SUMMARY

Some embodiments of the present disclosure include a shipyard. The shipyard includes a yard defining a yard level. A shiplift platform is positioned adjacent the yard. A lifting system is coupled with the yard. The lifting system includes a hoist coupled with a hoist frame. The hoist is capable of coupling with the shiplift platform and raising and lowering the shiplift platform relative to the yard level. The lifting system includes a jack. The jack includes an actuator coupled with a jack frame and with the hoist frame. The actuator is actuable to raise the hoist above the yard level and is actuable to raise the shiplift platform above the yard level.

Some embodiments of the present disclosure include a shiplift. The shiplift includes a shiplift platform and a lifting system. The lifting system includes a hoist coupled with a hoist frame. The hoist is capable of coupling with the shiplift platform and raising and lowering the shiplift platform. The lifting system includes a jack. The jack includes an actuator coupled with a jack frame and with the hoist frame. The actuator is actuable to raise the hoist and is actuable to raise the shiplift platform.

Some embodiments of the present disclosure include a rotary chain jack. The rotary chain jack includes a hoist coupled with a hoist frame, and a jack including an actuator coupled with a jack frame and with the hoist frame.

Some embodiments of the present disclosure include a method of lifting a shiplift platform above a yard level of a shipyard. The method includes jacking-up a hoist. The hoist is positioned adjacent the shiplift platform at the shipyard. During the jacking-up of the hoist, the hoist is decoupled from the shiplift platform. The jacking-up of the hoist includes raising the hoist, relative to the yard level, from a first hoist height to a second hoist height. The method includes securing the hoist at the second hoist height, and coupling the hoist, at the second hoist height, with the shiplift platform. With the hoist at the second hoist height and coupled with the shiplift platform, the method includes jacking-up the shiplift platform by raising the shiplift platform toward the hoist, from a first platform height to a second platform height, and securing the shiplift platform at the second platform height.

BRIEF DESCRIPTION OF THE DRAWINGS

So that the manner in which the features and advantages of the systems and methods may be understood in more detail, a more particular description may be had by reference to the embodiments which are illustrated in the appended drawings that form a part of this specification. It is noted, however, that the drawings illustrate only various exemplary embodiments and are, therefore, not to be considered limiting of the disclosed concepts as it may include other effective embodiments as well.

Figure 1:
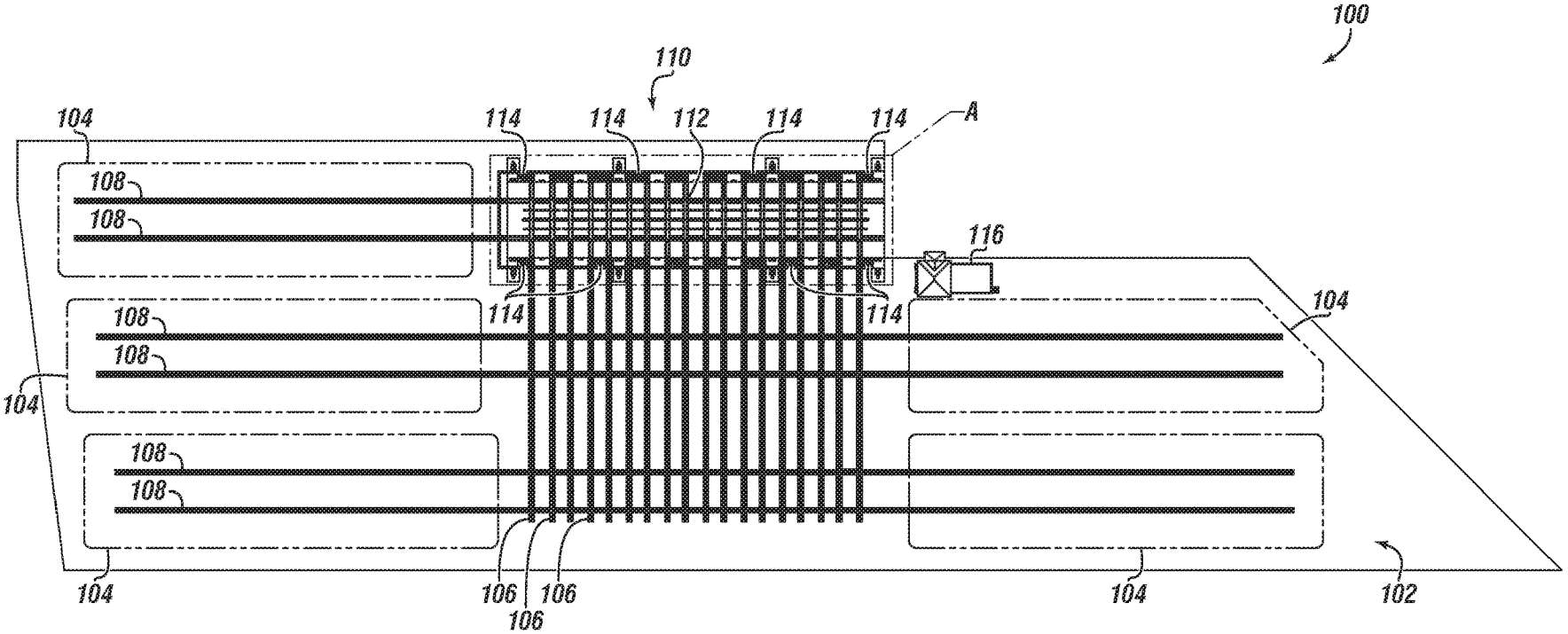
FIG. 1 is a plan view of a shipyard.

Systems and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

Certain aspects of the present disclosure include systems and methods for lifting a shiplift platform above a level of a shipyard, also referred to herein as "yard level." As used herein, "yard level" refers to a plane defined by the yard (or floor) of a shipyard. One skilled in the art would understand that the plane defined by the yard (also referred to as a "quay") of a shipyard will exhibit variations relative to a theoretical "perfect plane" without departing from the scope of this disclosure. In some embodiments, the systems and methods disclosed herein provide for the ability to more easily or readily perform maintenance of and on shiplift platforms. That is, the systems and methods disclosed herein allow for shiplift platforms to be lifted above the yard level such that the bottom of the shiplift platforms are more easily and readily accessible for maintenance than if the shiplift platforms were positioned at or below the yard level. Such maintenance may include, but is not limited to, welding, painting, coating, and replacement of parts. For example, and without limitation, such maintenance may be performed every 1 to 20 years, every 2 to 18 years, every 4 to 16 years, every 6 to 14 years, every 8 to 12 years, or every 10 years. Without being bound by theory, it is believed that existing wire rope winch systems used to lift shiplift platforms are not capable of lifting a shiplift platform above yard level.

In some embodiments, to lift a shiplift platform above yard level, one or more lifting systems (e.g., hoists) are used to lift the shiplift platform, and the lifting system(s) and shiplift platform are jacked up to a position that is above yard level using a jack. The shiplift platform and lifting system(s) may be incrementally jacked up to a position above yard level, such as by using an actuator. In some embodiments, a linear actuator, such as a hydraulic or pneumatic cylinder/rod, is actuated one incremental movement (e.g., one stroke) at a time to lift the shiplift platform and lifting system(s). In some embodiments, the linear actuator is hydraulically actuated, pneumatically actuated, or electrically actuated. While the "lifting system" and "jack" are sometimes referred to as separate structure herein, in some embodiments the "jack" is an integral component of the "lifting system" rather than a separate structure. As used herein a "cylinder/rod" refers to an assembly of a cylinder and rod, where the rod is coupled within the cylinder and is extendable and retractable relative to the cylinder. Additionally, the cylinder is extendable and retractable relative to the rod. For example, the shiplift platform may be lifted up one cylinder/rod stroke, and then blocking may be added to the raised lifting system(s) (e.g., rotary chain jacks) to maintain the first lifted position. Blocking, or the addition of blocking, may be accomplished via use of the jacking frames, jacking beams, and associated pins. The actuator may then be recycled (e.g., retracted), such that the shiplift platform is pulled upwards towards the lifting system(s). The cylinder/rod or other actuator may then be used to jack another movement (e.g., stroke) to further lift the lifting system(s) and shiplift platform, as desired. Such a process incrementally raises the shiplift platform to a desired height above the yard level. In some embodiments, the jacking up of the shiplift platform may be accomplished, in part, using shiplift chain jacks, which may serve the dual functions of both lifting ships for typical shiplift functions and lifting the shiplift platform above yard level for maintenance thereof. As there are typically a plurality of lifting systems used to lift a shiplift platform, the jacking up of the plurality of lifting systems is, in some embodiments, synchronized such that each lifting system is simultaneously and synchronously jacked up to the same height as the other of the lifting systems. In some embodiments, a rotary chain jack including a lift cylinder is used as the lifting system.

Shipyard

Some embodiments of the present disclosure include a shipyard that includes lifting systems, such as hoists, that are coupled with a shiplift platform and jacks that are capable of lifting the lifting systems and the shiplift platform above the yard level of the shipyard. With reference to FIG. 1, shipyard 100 is depicted. Shipyard 100 includes yard 102. Yard 102 includes bays 104 where ships and other such structures may be positioned, such as for maintenance, storage, construction, or other activities. Yard 102 may be equipped with lateral rails 106 and longitudinal rails 108 for transport of ships and other such structures within and about shipyard 100, such as on carriages using bogie transfer systems.

Shipyard 100 includes shiplift 110 for receipt of and deployment of ships and other such structures to and from shipyard 100. Shiplift 110 includes shiplift platform 112. As described in more detail elsewhere herein, shiplift platform 112 may be coupled with a plurality of lifting systems 114, here shown as hoists. Lifting systems 114 operate to lift and lower shiplift platform 112, with or without a ship or other such structure thereon. Shipyard 100 also includes command post 116 for control of operations of shiplift 110, including control of lifting systems 114 and jacks (not shown).

Shiplift

Figure 2:
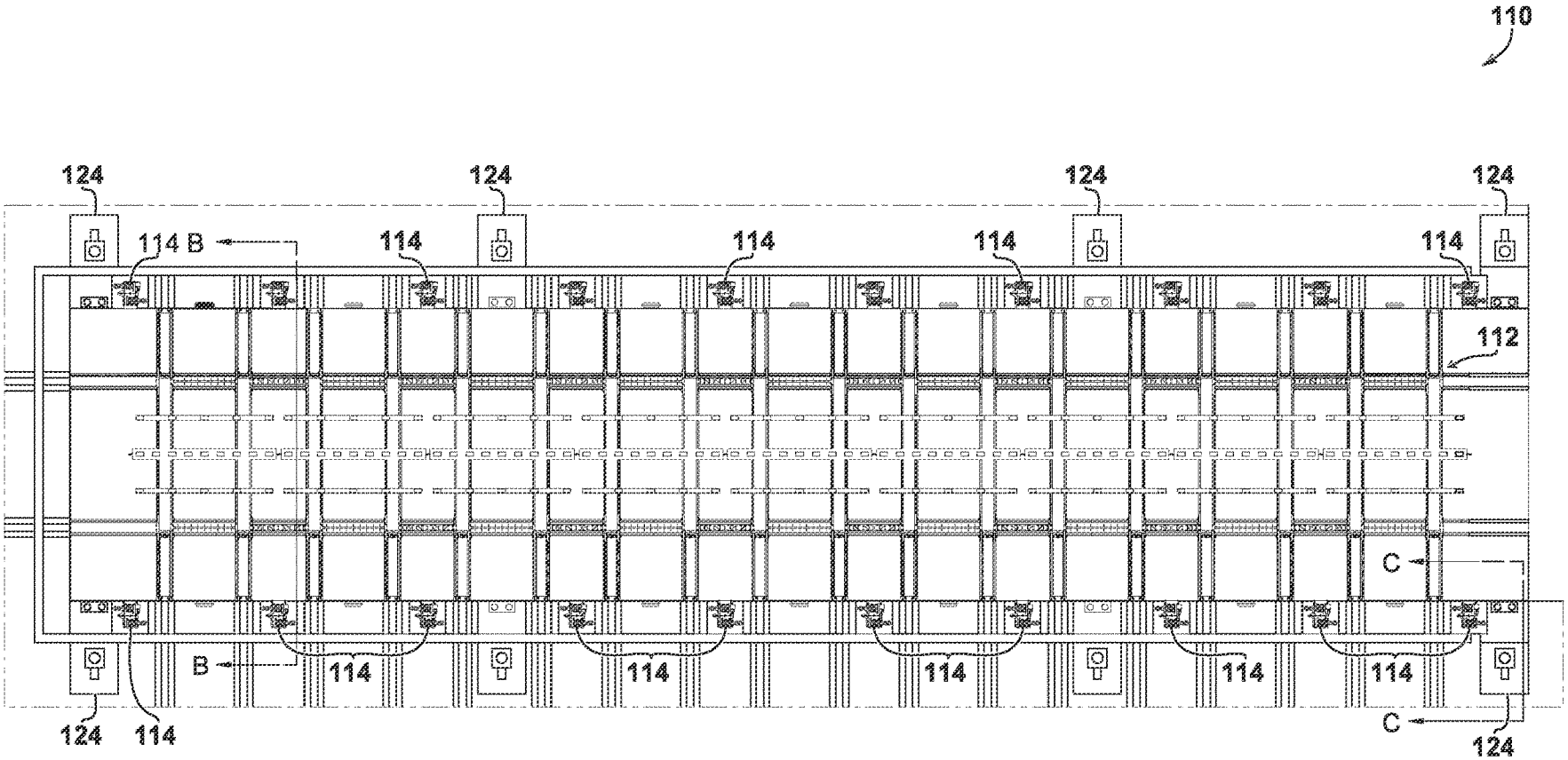
FIG. 2 is a detail view of section A of the shipyard of FIG. 1, showing a shiplift.

FIG. 2 is a detail view of shiplift 110, at section A of FIG. 1. Shiplift 110 includes shiplift platform 112, which is or includes a structure or frame capable of supporting a ship or other such structure. Lifting systems 114 are coupled with yard (shown in FIG. 1) and with shiplift platform 112, and are capable of raising and lowering shiplift platform 112. In operation, shiplift platform 112 is lowered by lifting systems 114 into the water to a level such that a ship or other such structure is floated above shiplift platform 112. Subsequently, lifting systems 114 raise shiplift platform 112 to bring the ship, supported on shiplift platform 112, at level with shipyard 100. Motors 124 (e.g., electric motors) provide power to lifting systems 114 for lowering and lifting shiplift platform 112. Of course, the above described operation may be reversed in order to deploy a ship or other such structure into the water.

Shiplift Platform in a Raised Position

Figure 3:
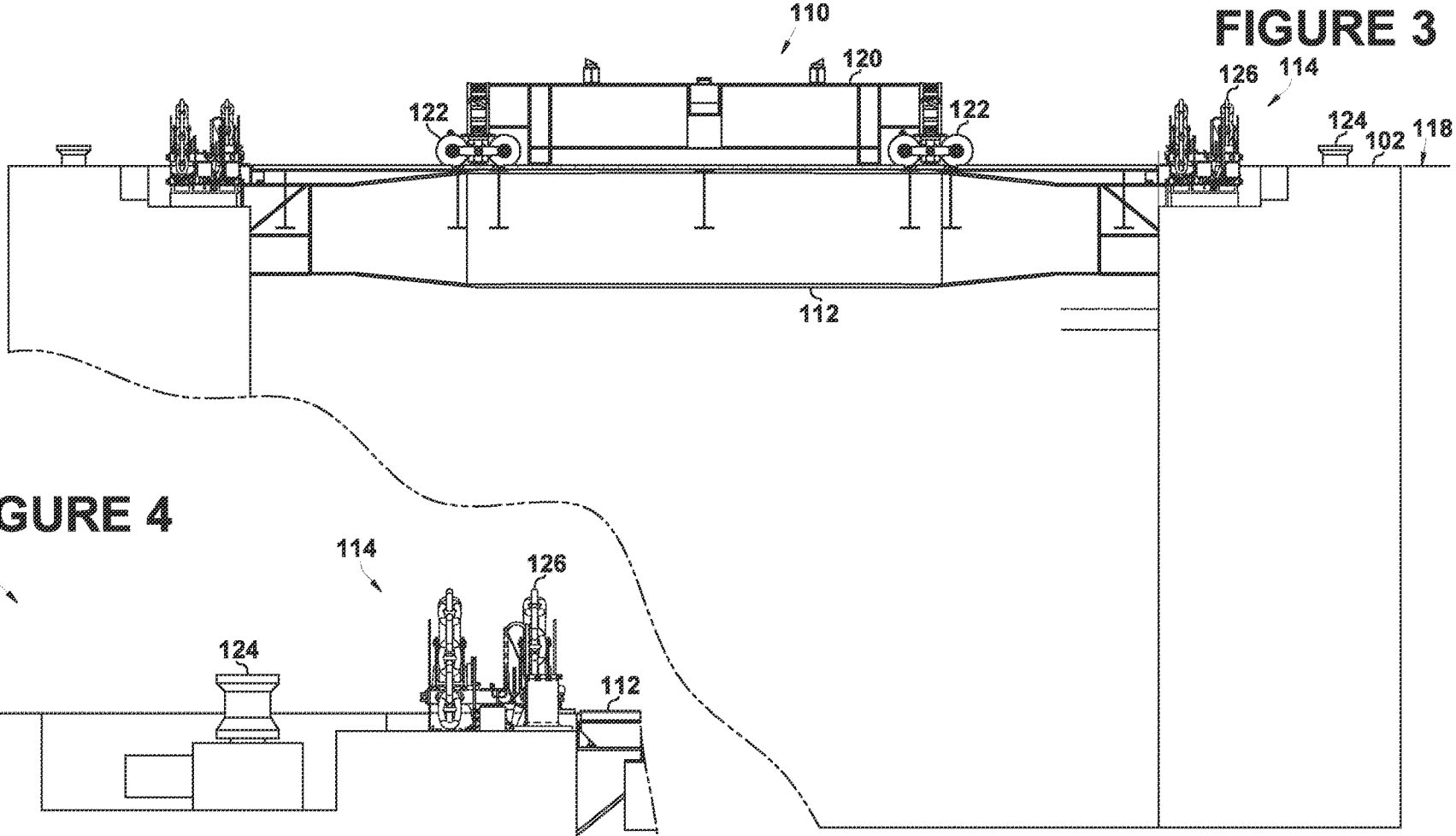
FIG. 3 is a cross-sectional view of section B-B of FIG. 2, showing the shiplift platform in a raised position.
Figure 4:
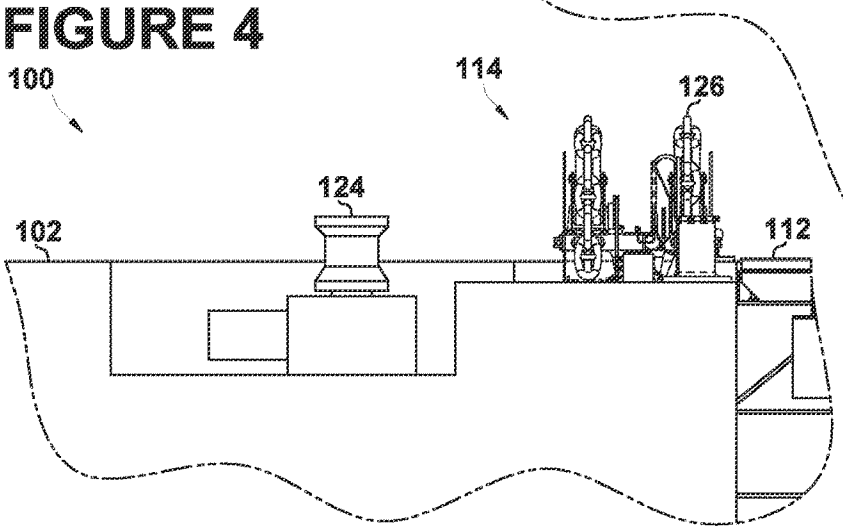
FIG. 4 is a cross-sectional view of section C-C of FIG. 2, showing a hoist used to lift the shiplift platform.

FIG. 3 is a cross-sectional view of a portion of shipyard 100 along line B-B of FIG. 2, with shiplift platform 112 in a raised position, and FIG. 4 is a cross-sectional view of a portion of shipyard 100 along line C-C of FIG. 2. With reference to FIGS. 3 and 4, shiplift 110 is raised to a height that is the same height as yard 102, such that shiplift platform 112 is even or substantially even with yard 102. That is, a theoretical plane defined by shiplift platform 112 is coplanar or substantially coplanar with a theoretical plane defined by yard 102, such that shiplift platform 112 and yard 102 are both at height 118.

Carriage 120 is positioned on top of shiplift platform 112, and bogies 122 are coupled with carriage 120 for transporting carriage 120, and any ship or other structure thereon, throughout shipyard 100, such as on rails 106 and 108 as shown in FIG. 1.

In some embodiments, lifting system 114 is or includes a rotary chain jack. In some such embodiments, lifting systems 114 lift and lower shiplift platform 112 via hauling in or paying out chain 126, with chain 126 coupled to shiplift platform 112. Lifting systems 114 may be powered by and/or controlled by motors 124. The movement of ships and other such structures throughout a shipyard is described in U.S. Provisional Patent Application No. 62/591,013 (the '013 application) and in U.S. patent application Ser. No. 16/201,978 (the '978 application), the entireties of which are incorporated herein by reference. Also, the operation of some embodiments of shiplifts is described in U.S. Provisional Patent Application No. 62/568,921 (the '921 application) and in U.S. patent application Ser. No. 15/817,876 (the '876 application), the entireties of which are incorporated herein by reference. While the present disclosure is not limited to moving ships and other such structures throughout shipyards in the manners described in the '013 and '978 applications and is not limited to operating shiplifts in the manners described in the '921 and '876 applications, these disclosures provide relevant background, and the methods and systems disclosed herein may be practiced in conjunction with those disclosed in the '013, '978, '921, and '876 applications.

Shiplift Platform in a Lowered Position

Figure 5:
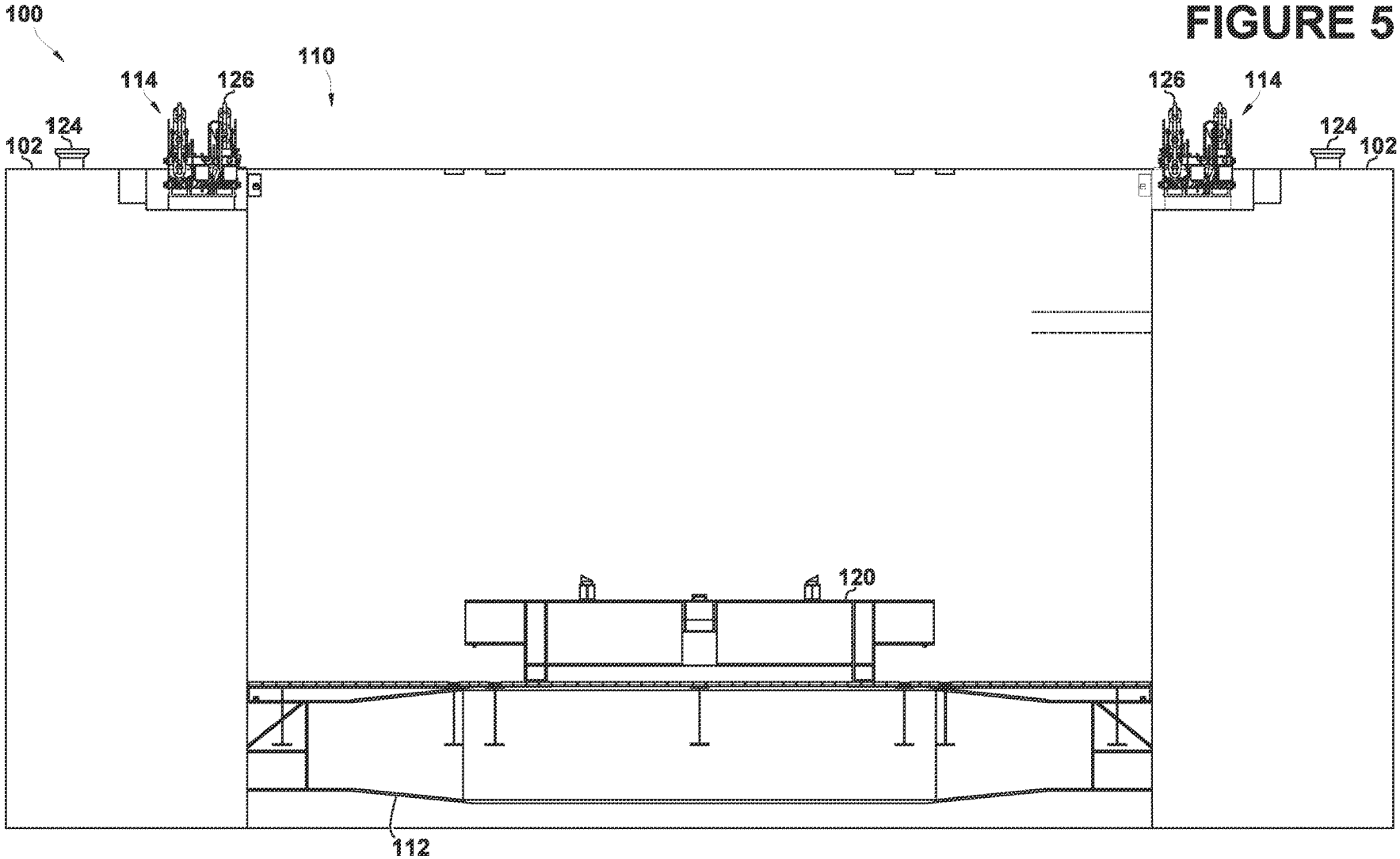
FIG. 5 is a cross-sectional similar to FIG. 3, but showing the shiplift platform in a lowered position.

FIG. 5 is a cross-sectional view of a portion of shipyard 100 along line B-B of FIG. 2, but with shiplift platform 112 in a lowered position, below a height of yard 102, instead of in a raised position. Carriage 120 is positioned on top of shiplift platform 112, but bogies 122 are not coupled with carriage 120. In operation, while in the lowered position a ship or other such structure may float over shiplift platform 112 and carriage 120 and may engage with carriage 120, such that lifting systems 114 are capable of lifting shiplift platform 112 and carriage 120; thereby, lifting the ship or other such structure thereon. Lifting systems 114 are capable of lifting shiplift platform 112, carriage 120, and any ship or other such structure thereon by hauling in chain 126. Of course, this operation may be reversed to deploy a ship from the shipyard.

Figure 6:
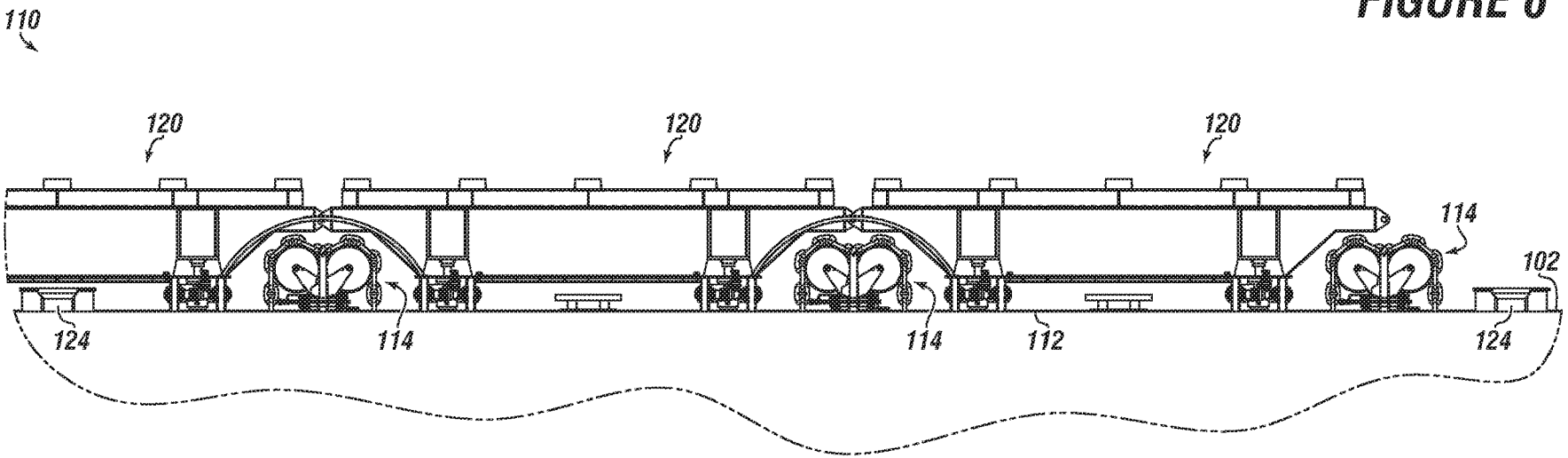
FIG. 6 is an elevation view showing carriages (also referred to as cradles) positioned on a shiplift.

With reference to FIG. 6, an elevation view of carriages 120 positioned on top of shiplift platform 112 is shown. As is evident from FIG. 6, side transfer of equipment over lifting systems 114 is possible. With adjacent carriages 120 engaged along the edges thereof, the carriages 120 are positioned over the lifting systems 114 such that the lifting systems 114 are protected beneath the carriages 120 and a contiguous surface is provided over the lifting systems 114 for the side/lateral transfer of equipment over the locations where the lifting systems 114 are positioned.

Jack

Figure 7C:
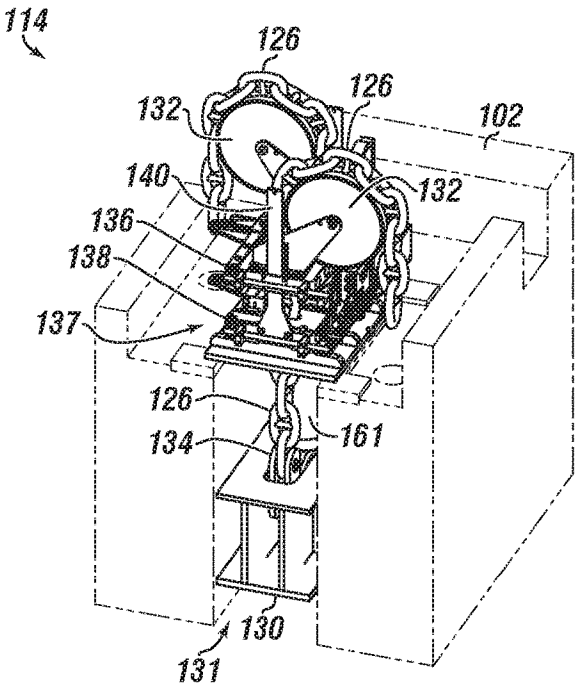
FIG. 7C is an isometric view of the hoist of FIG. 7A.
Figure 7B:
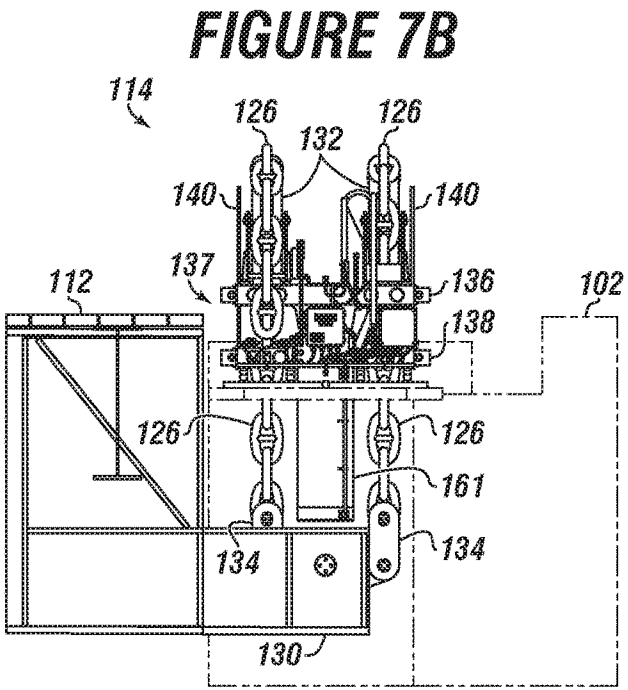
FIG. 7B is a side view of the hoist of FIG. 7A.
Figure 7A:
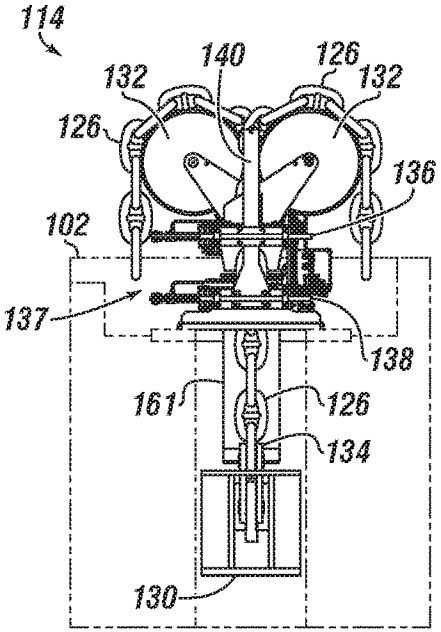
FIG. 7A is a front view of a hoist coupled with a shiplift platform.

FIGS. 7A-7C are detailed views of a lifting system coupled with a portion of a shiplift. Lifting system 114, here a rotary chain jack, is coupled with a portion of the shiplift platform, here shown as beam 130 of the shiplift platform. Beam 130 extends from the shiplift platform into cavity 131 that is formed in yard 102 and below lifting system 114. Lifting system 114 includes chains 126 engaged over chainwheels 132 and extending to and coupled with beam 130. Chains 126 are coupled with beam 130 via chain plates 134. Chains 126 may be coupled with beam 130 via other methods and techniques. Lifting system 114 includes movable frame 136 (also referred to herein as a "hoist frame") movably coupled with frame track 140. In FIGS. 7A-7C, shiplift platform 112 is in the raised position, such that shiplift platform 112 is coplanar or substantially coplanar with yard 102.

Lifting system 114 includes or is coupled with jack 137. Jack 137 includes jack frame 138 and cylinder/rod, of which cylinder 161 is shown. Cylinder/rod may be a hydraulic or pneumatic cylinder/rod. As shown and described in more detail below, jack 137 is capable of lifting the lifting system 114 or portions thereof and is capable of lifting shiplift platform 112.

Lift cylinder 161 (e.g., chain jack lift cylinder) is connected to the lifting system 114 and protrudes downward therefrom towards beam 130 within cavity 131. In operation, lifting system 114 and lift cylinder 161 may be lifted up with shiplift platform 112, such as to avoid a clash between beam 130 and lift cylinder 161.

Installation of Jacking Beams

Figure 8C:
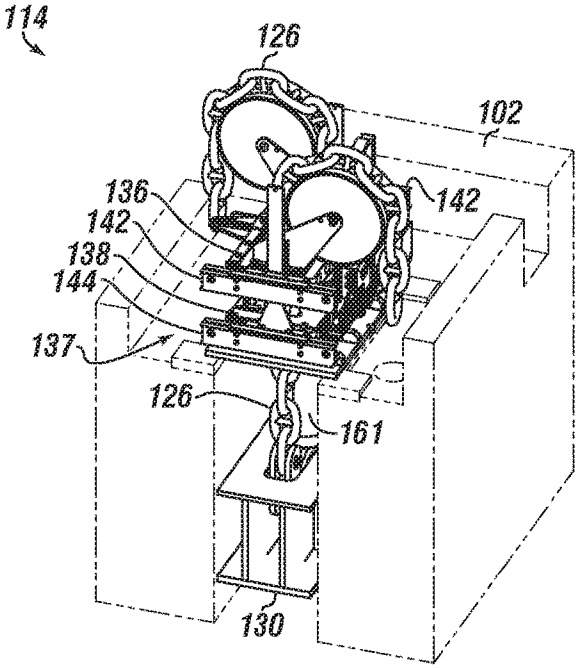
FIG. 8C is an isometric view of the hoist of FIG. 8A.
Figure 8B:
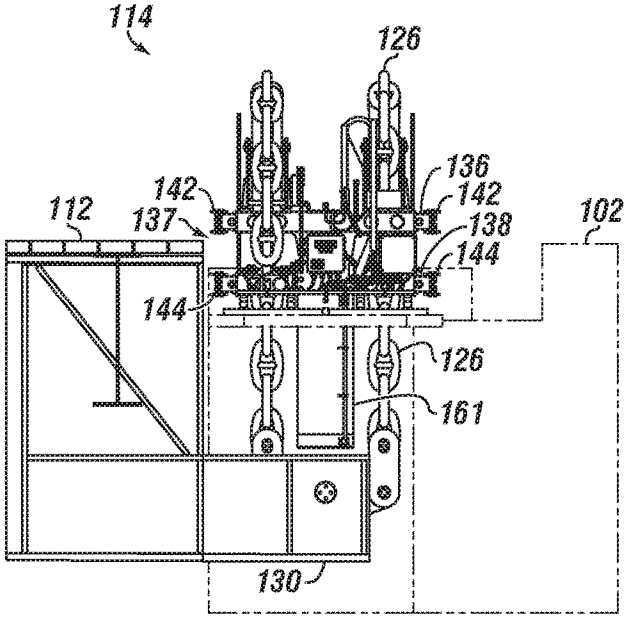
FIG. 8B is a side view of the hoist of FIG. 8A.
Figure 8A:
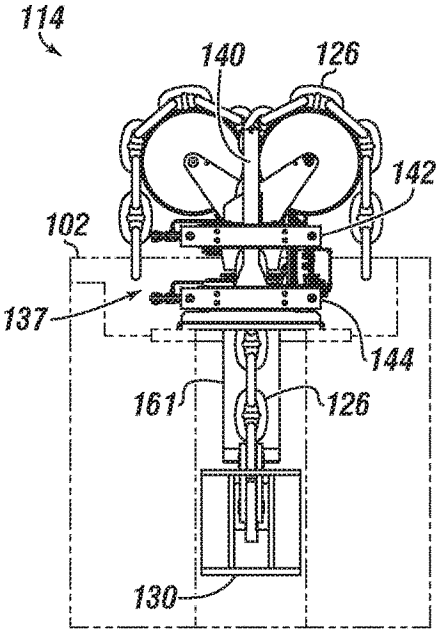
FIG. 8A is a front view of the hoist of FIG. 7A with jacking beams installed thereon.

In some embodiments, jack 137 includes jacking beams coupled with jack frame 138 and with frame 136 of lifting system 114. FIGS. 8A-8C depict the installation of beams onto crossarms of frames 136 and 138. Jacking beams 142 and 144 are coupled (e.g., bolted) with crossarms of frame 136 and frame 138, respectively. While the jacking beams are shown as being separate parts that are coupled with frames 136 and 138, in some embodiments, the jacking beams are integral with these frames.

Installation of Jacking Columns

Figure 9C:
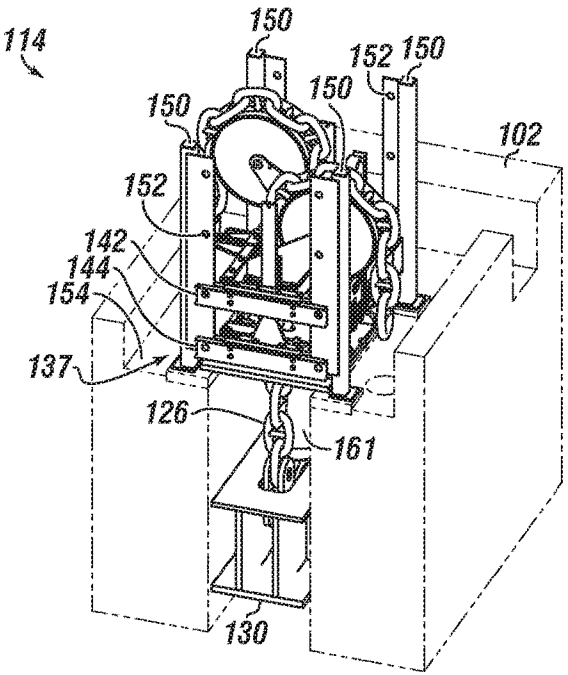
FIG. 9C is an isometric view of the hoist of FIG. 9A.
Figure 9B:
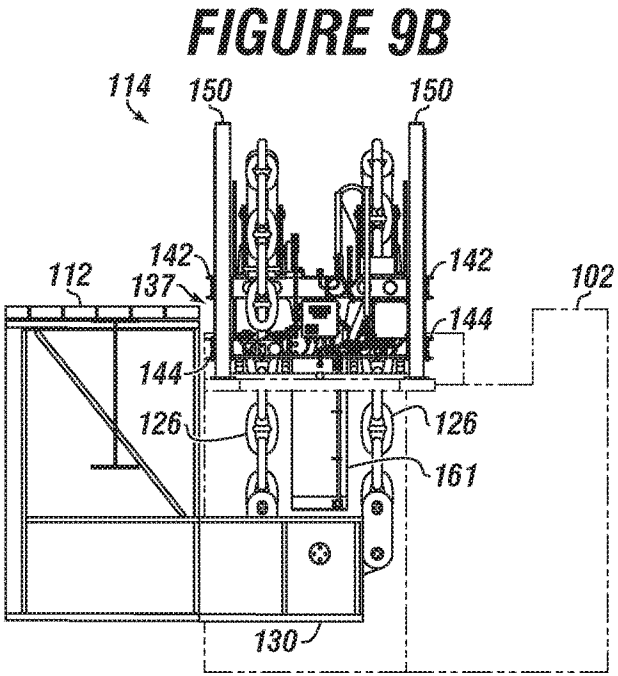
FIG. 9B is a side view of the hoist of FIG. 9A.
Figure 9A:
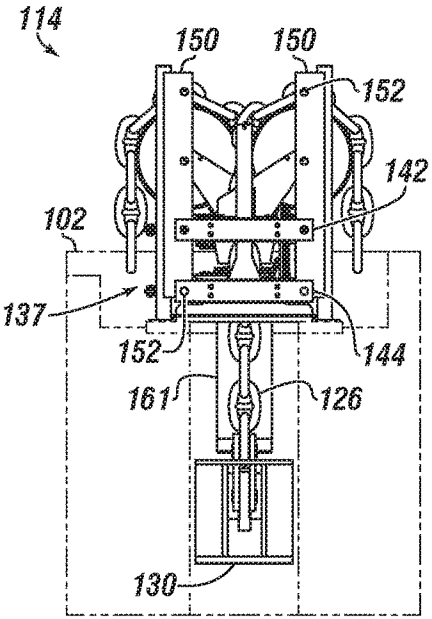
FIG. 9A is a front view of the hoist of FIG. 8A with jacking columns installed on a foundation thereof.

In some embodiments, jack 137 includes jacking columns or legs. FIGS. 9A-9C depict the installation of jacking columns onto foundation 154 (e.g., concrete foundation) of yard 102. Jacking columns 150 are coupled about and/or proximate lifting system 114. While shown as including four jacking columns, the jack disclosed herein is not limited to having four jacking columns. Each jacking column 150 and each jacking beam 142 and 144 includes one or more holes 152 therethrough for selective engagement between jacking columns 150 and jacking beams 142 and 144. For example, holes on jacking beams 142 and 144 can be aligned with holes on jacking columns 150, and the jacking beams 142 and 144 can be pinned to the jacking columns 150 by inserting pins through the aligned holes. While shown as including holes for pinning or otherwise coupling jacking beams 142 and 144 with jacking columns 150, the jacking beams and columns are not limited to such a structure. Furthermore, the jack 137 disclosed herein is not limited to the particular structure of jacking columns and beams, and may be or include other structures capable of jacking up the lifting systems and the shiplift platform above yard level 102.

Jacking Up the Lifting System

Figure 10C:
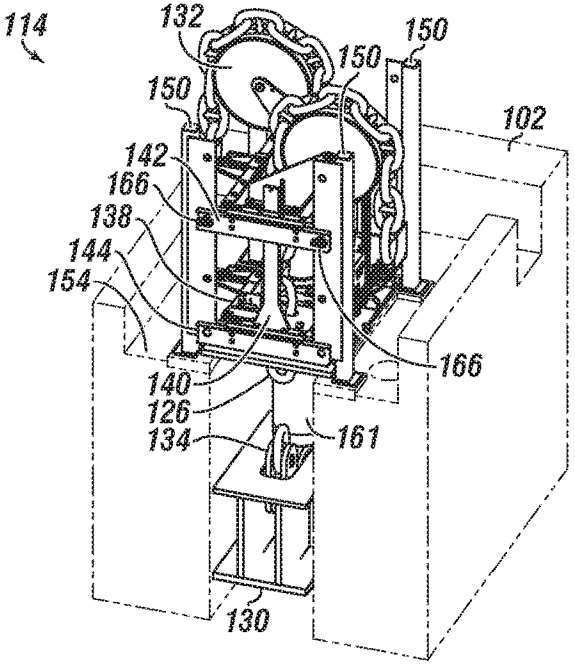
FIG. 10C is an isometric view of the hoist of FIG. 10A.
Figure 10B:
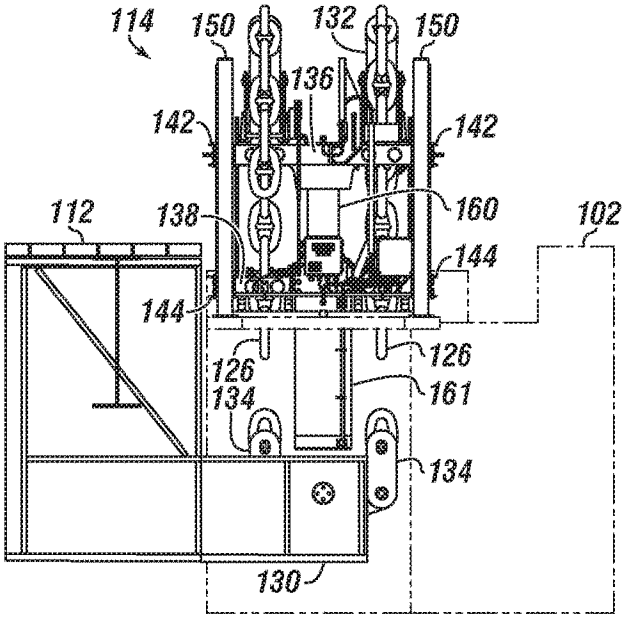
FIG. 10B is a side view of the hoist of FIG. 10A.
Figure 10A:
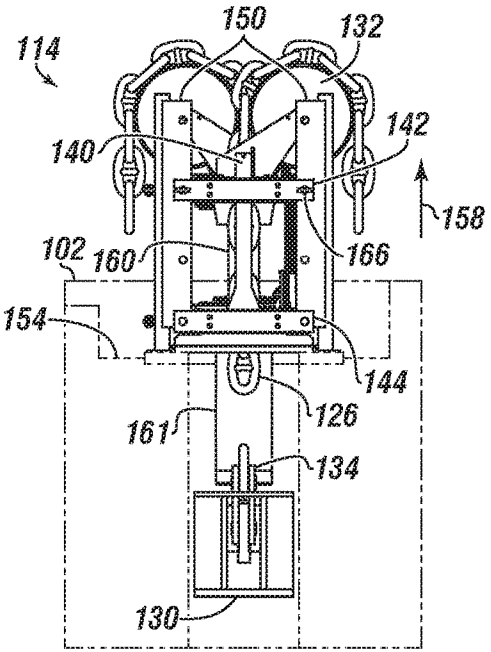
FIG. 10A is a front view of the hoist of FIG. 9A after the hoist has been lifted via a jack.

To jack up the lifting system, the cylinder/rod of the jack is extended such that the lifting system or portions thereof are lifted upwards relative to the shipyard. With reference to FIGS. 10A-10C, lifting system 114 is lifted upwards along direction 158 via extension of rod 160 relative to cylinder 161 (e.g., hydraulic or pneumatic cylinder). Rod 160 may be coupled with and between frame 136 and frame 138, such that extension of rod 160 causes frame 136 to move upwards relative to frame 138, while also raising chain wheels 132. In the embodiment shown, frame 136 is the frame upon which chain wheels 132 are coupled, and frame 138 is the frame upon which rod 160/cylinder 161 is mounted. The lifting of chain wheels 132, as shown in FIGS. 10A-10C, is performed with chains 126 decoupled from beam 130 (i.e., with lifting system 114 decoupled from shiplift platform 112). Also, prior to raising lifting system 114 using rod 160, lifting system 114 is decoupled from foundation 154, such as via unbolting frame 136 and/or frame 138 from foundation 154. When rod 160 extends, jacking beam 142 (also referred to as a traveling crossarm) moves (e.g., slides) along tracks 140. Lifting system 114 is lifted to a desired height, such that pin holes 152 in jacking beam 142 align with pin holes 152 in jacking columns 150. At the desired height, jacking beam 142 is pinned to jacking columns 150 via pins 166 extending through the aligned pin holes 152. The height in FIGS. 10A-10C correspond with the height of lifting system 114 after being lifted by a single stroke of rod 160. The system disclosed herein is not limited to being pinned via pins, and may be coupled in another manner. Such pinning (or other coupling) maintains the raised position of lifting system 114. In operation, this first extension of jacking rods 160 lifts lifting system 114, and a second actuation of jacking rods lifts shiplift platform 112. In typical operations, jacking rods 160 also function to facilitate the lifting of ships onto shiplift platform 112.

Retraction of Cylinder and Jacking Up of Shiplift Platform

Figure 11C:
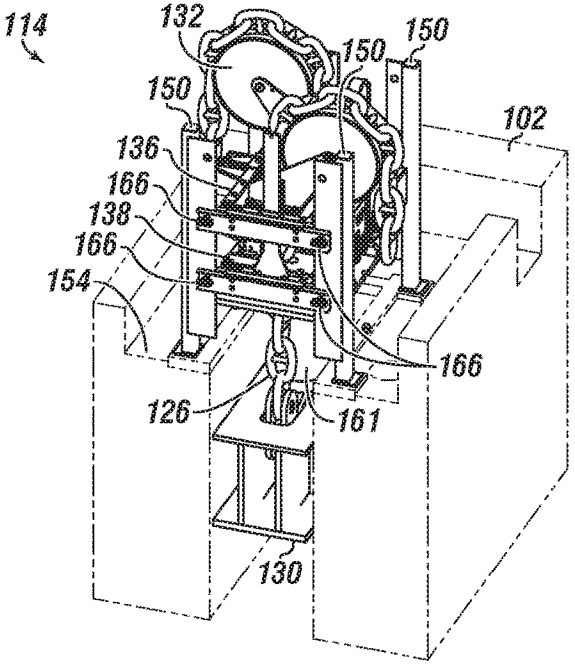
FIG. 11C is an isometric view of the hoist of FIG. 11A.
Figure 11B:
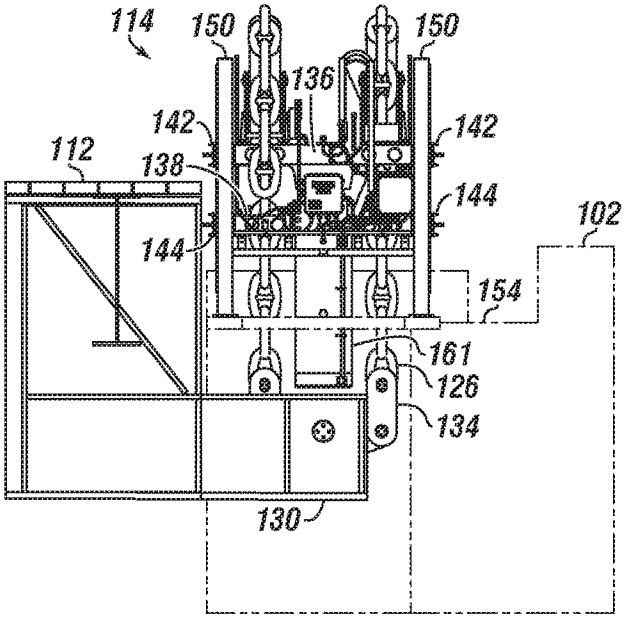
FIG. 11B is a side view of the hoist of FIG. 11A.
Figure 11A:
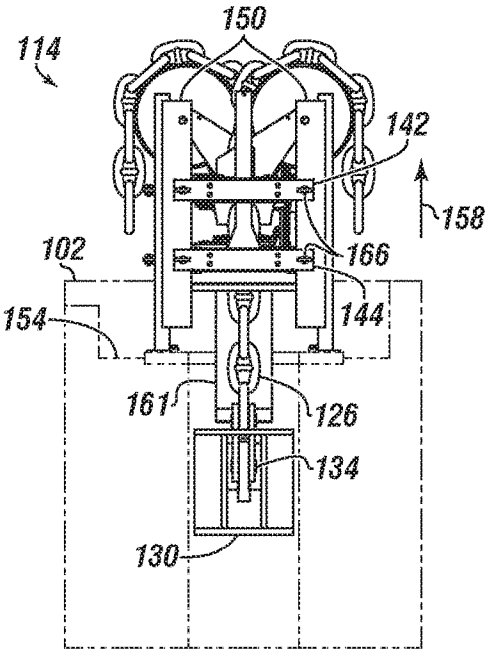
FIG. 11A is a front view of the hoist of FIG. 10A after the jack has been lifted via retraction of a cylinder/rod thereof.

To lift the shiplift platform, the cylinder 161 of the jack 137 is retracted towards the lifting system 112, such that the frame 138 and the shiplift platform 112 are lifted upwards relative to the yard 102. With reference to FIGS. 11A-11C, chains 126 are recoupled with beam 130 and cylinder 161 is retracted such that shiplift platform 112 is raised upwards along direction 158. Also, fame 138 and jacking beam 144 are pulled upwards by retracting cylinder 161. Jacking beam 144 is then pinned to jacking columns 150 via pins 166 extending through pin holes 152 in both jacking columns 150 and jacking beam 144 to maintain a position of both the jack. With this second actuation of jacking cylinder/rod, shiplift platform 112 is raised to a level that is above the level of yard 102.

Figure 12C:
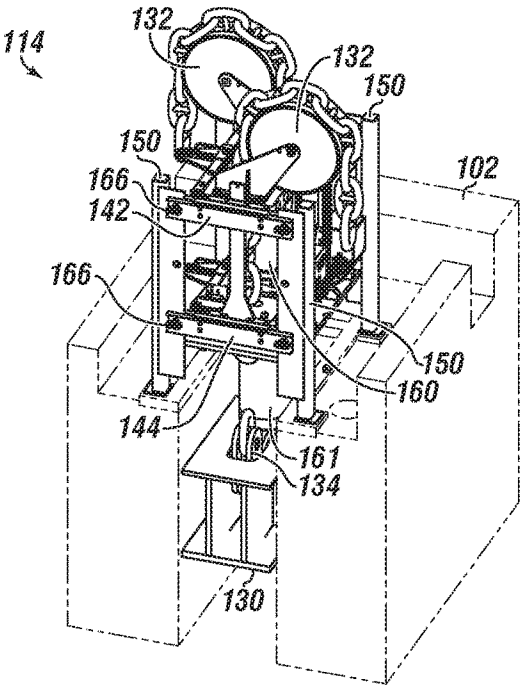
FIG. 12C is an isometric view of the hoist of FIG. 12A.
Figure 12B:
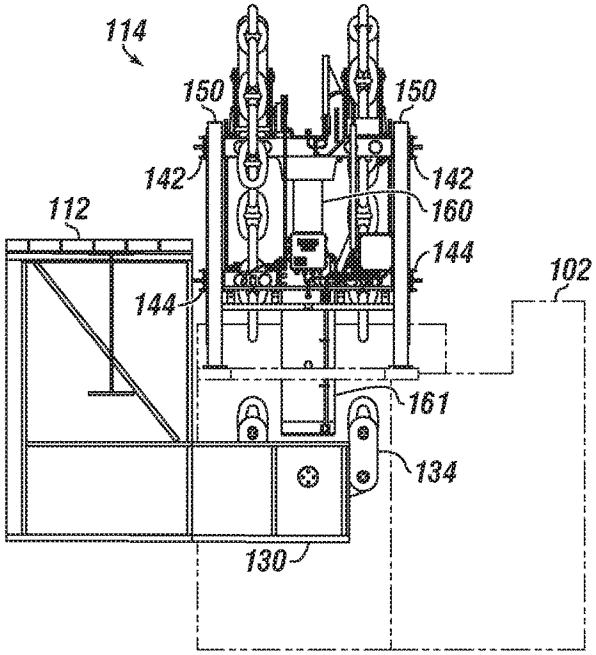
FIG. 12B is a side view of the hoist of FIG. 12A.
Figure 12A:
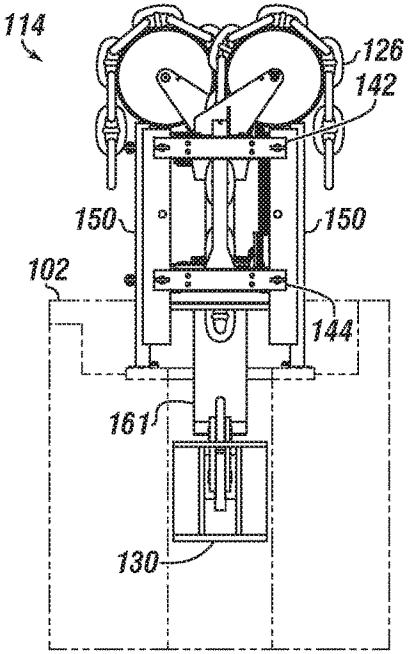
FIG. 12A is a front view of the hoist of FIG. 11A after the hoist has been lifted a second time via extension of the cylinder/rod.

With reference to FIGS. 12A-12C, the process is repeated with another stroke of rod 160. That is, pins 166 through jacking beam 142 and jacking columns 150 are removed from the position shown in FIGS. 10A-10C, and rod 160 is extended to further raising lifting system 114. Pins 166 are then re-installed through the aligned pin holes in jacking beam 142 and jacking columns 150 at a second desired height. Here, the second desired height corresponds with the height of lifting system 114 after being lifted by two strokes of rod 160.

Figure 13C:
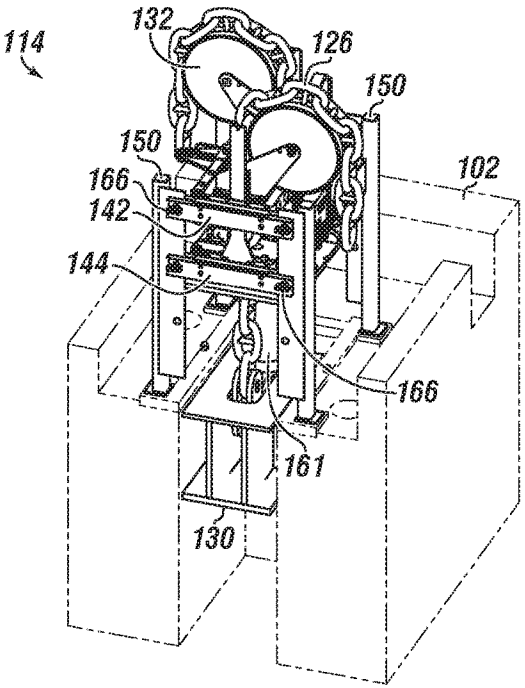
FIG. 13C is an isometric view of the hoist of FIG. 13A.
Figure 13B:
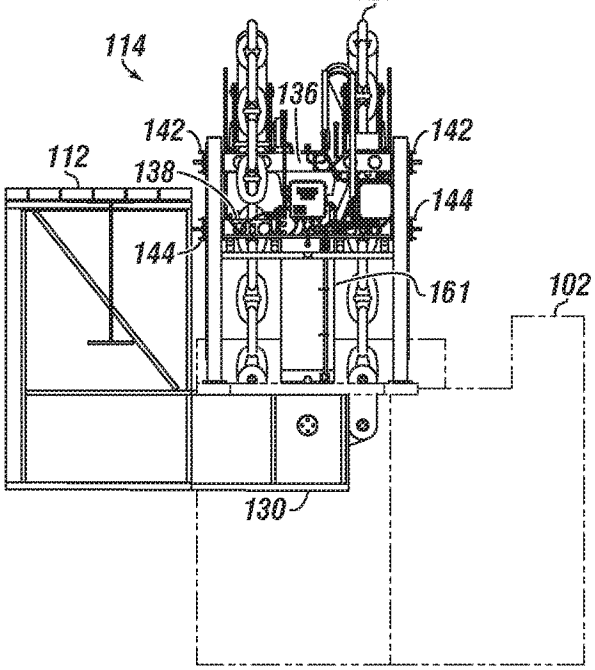
FIG. 13B is a side view of the hoist of FIG. 13A.
Figure 13A:
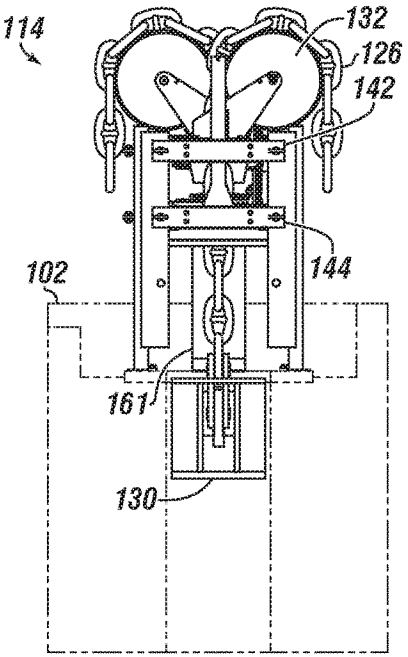
FIG. 13A is a front view of the hoist of FIG. 12A after the jack has been lifted a second time via retraction of the cylinder/rod.

With reference to FIGS. 13A-13C, shiplift platform 112 is raised even higher relative to yard 102 than is shown in FIGS. 11A-11C. Chains 126 are recoupled with beam 130 and cylinder 161 is retracted such that shiplift platform 112 is raised upwards along direction 158. Also, fame 138 and jacking beam 144 are pulled upwards by retracting cylinder 161, and jacking beam 144 is pinned to jacking columns legs 150 via pins 166 extending through pin holes 152 in both jacking columns 150 and jacking beam 144 to maintain a position of both the j ack.

In some embodiments, the systems and methods disclosed herein are capable of elevating a shiplift platform from a position even with or below yard level to another position that is above yard level, such as for periodic maintenance and painting of the shiplift platform. Such elevation of a shiplift platform above yard level is useful for operations that require access to the shiplift platform, gimbals, chains, chain plates, or other parts. Such elevation of a shiplift platform above yard level provides for safety and ease of execution of such maintenance and operations.

In contrast to winch systems, chain jacks can be separated from the concrete foundation to which the chain jacks are attached. As such, the "built-in" hydraulic jacking system disclosed herein is capable of raising the entire chain jack platform to any height necessary for access to the shiplift platform. While shown as being lifted by two cylinder strokes, the present disclosure is not limited to use of two cylinder strokes, and may include lifting using only one cylinder stroke or lifting using more than two cylinder strokes. One skilled in the art would understand that the number of actuations of the actuator, in order to lift both the lifting systems and shiplift platform, can be varied without departing from the scope of this disclosure.

One exemplary sequence of steps for elevating a shiplift platform includes: (1) uncoupling (e.g., unbolting) the lifting systems (e.g., chain jacks) from the concrete structural foundation of the shipyard; (2) placing a number (e.g., four) jacking systems (e.g., structural jacking columns) around each lifting system; (3) installing jacking beams onto cross arms of the lifting system; (4) disengaging traveling cross arm latch pins that hold a position of the traveling cross arm of the lifting systems; (5) extending the traveling cross arms; (6) inserting pins into the jacking columns and upper jacking beams; (7) retracting the chain jack, and lifting the fixed cross arm, chains, and platform in unison; (8) inserting pins into the jacking columns and lower jacking beams; (9) extending the chain jack until the load transfers to the lower jacking beams; (10) removing the pins from the upper jacking beams; (11) continuing to extend the chain jack to prepare for the second lifting stroke; (12) inserting pins into the jacking columns and upper jacking beams; (13) retracting the chain jack to continue lifting the shiplift platform for the second stroke; and (14) inserting pins into the jacking columns and upper jacking beams.

In one particular embodiment, each stroke of the cylinder lifts the shiplift platform, chains, gimbals and chain jacks by 565 mm, and two strokes lifts the shiplift platform, chains, gimbals and chain jacks by 1130 mm. The systems and methods disclosed herein are not limited to 565 mm strokes, and may include strokes that are less than or greater than 565 mm. The height of the jacking columns can be selected to provide a desired length for a desired number of strokes to achieve a desired shiplift platform height after lift. The number of pin holes in the jacking columns can be designed to provide a gradience of locations along the jacking columns that matches the gradience of the cylinder strokes. That is, the jacking columns can have pin holes that are spaced by a distance along the jacking columns that is equal to the stroke distance (e.g., 565 mm). The systems and methods disclosed herein may also be used to install shiplift platforms, such as during the construction stage of a project that includes constructing a shiplift platform at a shipyard.

The systems and methods disclosed herein provide the ability to jack up the lifting systems to provide access for maintenance, and provide the ability to lower (jack down) the lifting systems for other operations. As a further example, when transferring a ship that has been lifted laterally onto land over the top of the lifting systems, the profile of the hoists are kept low (jacked down) to provide space for movement of the ship there-above (e.g., see FIG. 6). Also, when the lifting systems are raised up, it may be difficult to access the lifting systems for maintenance thereof; thus, the lifting systems may be in the lowered (jacked down) position to provide access for maintenance.

While the lifting systems and jack are shown and described as being used to lift shiplift platforms, the systems disclosed herein are not limited to being used for lifting shiplift platforms, and may be used to lift other structures. Also, the lifting systems and jack shown and described herein are not limited to the particular structures and arrangements shown. The lifting system may be another structure capable of lifting a shiplift platform, and the jack may be another structure capable of lifting the lifting system and shiplift platform.

Winch and Temporary Jack

While the embodiments shown and described herein include the use of a rotary chain jack for lifting both the shiplift platform and the chainwheel, the systems and methods disclosed herein are not limited to use of a rotary chain jack, and may include other structures or combinations of structures that are capable, individually or in combination, of lifting both the shiplift platform and the hoist. For example, and without limitation, in some embodiments the hoists of the shiplift platform are or include a plurality of winches coupled with the shiplift platform for lifting and lowering the shiplift platform. In some embodiments, the winches can be used to lift the shiplift platform to a position that is coplanar or substantially coplanar with the yard level, and then jacks can be positioned to engage with the winches to lift the winches (disconnected from the yard), followed by additional lifting of the shiplift platform to a level that is above the yard level. In some such embodiments, the jacks are separate structures from the winches and are not integral with the winches. For example, the jacks can be temporary jacks that are temporarily positioned at the shiplift to lift up the winches and shiplift platform, the position of which may then be maintained (pinned off) as described elsewhere herein (e.g., using the jacking columns and beams). In some such embodiments, the jacks are "pancake" jacks. The jacks can be installed under the winches to lift the winches up along with the shiplift platform. In some embodiments, the winches (e.g., winch frames) are coupled with or engaged with the jacks such that the jacks, reacting between the winches and the foundation of the yard (e.g., concrete foundation) impart force onto the winches to push the winches upwards relative to the yard.

Some Exemplary Embodiments

Embodiment 1. A shipyard, the shipyard comprising: a yard, the yard defining a yard level; a shiplift platform positioned adjacent the yard; a lifting system coupled with the yard, the lifting system comprising: a hoist coupled with a hoist frame, wherein the hoist is capable of coupling with the shiplift platform and raising and lowering the shiplift platform relative to the yard level; and a jack, the jack comprising an actuator coupled with a jack frame and with the hoist frame, wherein the actuator is actuable to raise the hoist above the yard level and is actuable to raise the shiplift platform above the yard level.

Embodiment 2. The shipyard of embodiment 1, wherein the actuator is actuable into at least two positions including a first position and a second position, wherein in the first position the hoist frame and the jack frame are spaced apart by a first distance, wherein in the second position the hoist frame and the jack frame are spaced apart by a second distance, and wherein the second distance is greater than the first distance.

Embodiment 3. The shipyard of embodiment 2, wherein the actuator is a linear actuator, wherein the first position is a retracted position of the linear actuator and the second position is an extended position of the linear actuator.

Embodiment 4. The shipyard of embodiment 3, wherein the linear actuator is a hydraulic, pneumatic, or electric jack comprising a rod movably engaged within a cylinder, wherein one of the rod or the cylinder is coupled with the hoist frame, and wherein the other of the rod and the cylinder is coupled with the jack frame.

Embodiment 5. The shipyard of any of embodiments 1 to 4, wherein the jack comprises a jacking column capable of being coupled with the yard; wherein, with the jacking column coupled with the yard, the hoist frame is capable of being coupled with the jacking column to maintain a position of the hoist frame relative to the jacking column; and wherein, with the jacking column coupled with the yard, the jack frame is capable of being coupled with the jacking column to maintain a position of the jack frame relative to the jacking column.

Embodiment 6. The shipyard of embodiment 5, further comprising jacking beams capable of coupling the hoist frame with the jacking column to maintain the position of the hoist relative to the jacking column and capable of coupling the jack frame with the jacking column to maintain the position of the jack frame relative to the jacking column.

Embodiment 7. The shipyard of any of embodiments 1 to 6, wherein the lifting system comprises a rotary chain jack, the rotary chain jack comprising a chainwheel, a chain coupled with the chainwheel, wherein the chain is capable of being coupled with the shiplift platform.

Embodiment 8. A shiplift, the shiplift comprising: a shiplift platform; a lifting system comprising: a hoist coupled with a hoist frame, wherein the hoist is capable of coupling with the shiplift platform and raising and lowering the shiplift platform; a jack, the jack comprising an actuator coupled with a jack frame and with the hoist frame, wherein the actuator is actuable to raise the hoist and is actuable to raise the shiplift platform.

Embodiment 9. The shiplift of embodiment 8, wherein the actuator is actuable into at least two positions including a first position and a second position, wherein in the first position the hoist frame and the jack frame are spaced apart by a first distance, wherein in the second position the hoist frame and the jack frame are spaced apart by a second distance, and wherein the second distance is greater than the first distance.

Embodiment 10. The shiplift of embodiment 9, wherein the actuator is a linear actuator, wherein the first position is a retracted position of the linear actuator and the second position is an extended position of the linear actuator.

Embodiment 11. The shiplift of embodiment 10, wherein the linear actuator is a hydraulic, pneumatic, or electric jack comprising a rod movably engaged within a cylinder, wherein one of the rod or the cylinder is coupled with the hoist frame, and wherein the other of the rod and the cylinder is coupled with the jack frame.

Embodiment 12. The shiplift of any of embodiments 8 to 11, wherein the jack comprises a jacking, wherein the hoist frame is capable of being coupled with the jacking column to maintain a position of the hoist frame relative to the jacking column, and wherein the jack frame is capable of being coupled with the jacking column to maintain a position of the jack frame relative to the jacking column.

Embodiment 13. The shiplift of embodiment 12, further comprising jacking beams capable of coupling the hoist frame with the jacking column to maintain the position of the hoist relative to the jacking column and capable of coupling the jack frame with the jacking column to maintain the position of the jack frame relative to the jacking column.

Embodiment 14. The shiplift of any of embodiments 8 to 13, wherein the lifting system comprises a rotary chain jack, the rotary chain jack comprising a chainwheel, a chain coupled with the chainwheel, wherein the chain is capable of being coupled with the shiplift platform.

Embodiment 15. A rotary chain jack, the rotary chain jack comprising: a hoist coupled with a hoist frame; a jack, the jack comprising an actuator coupled with a jack frame and with the hoist frame.

Embodiment 16. The rotary chain jack of embodiment 15, wherein the actuator is actuable into at least two positions including a first position and a second position, wherein in the first position the hoist frame and the jack frame are spaced apart by a first distance, wherein in the second position the hoist frame and the jack frame are spaced apart by a second distance, and wherein the second distance is greater than the first distance.

Embodiment 17. The rotary chain jack of embodiment 16, wherein the actuator is a linear actuator, wherein the first position is a retracted position of the linear actuator and the second position is an extended position of the linear actuator.

Embodiment 18. The rotary chain jack of embodiment 17, wherein the linear actuator is a hydraulic, pneumatic, or electric jack comprising a rod movably engaged within a cylinder, wherein one of the rod or the cylinder is coupled with the hoist frame, and wherein the other of the rod and the cylinder is coupled with the jack frame.

Embodiment 19. The rotary chain jack of any of embodiments 15 to 18, wherein the jack comprises a jacking, wherein the hoist frame is capable of being coupled with the jacking column to maintain a position of the hoist frame relative to the jacking column, and wherein the jack frame is capable of being coupled with the jacking column to maintain a position of the jack frame relative to the jacking column.

Embodiment 20. The rotary chain jack of embodiment 19, further comprising jacking beams capable of coupling the hoist frame with the jacking column to maintain the position of the hoist relative to the jacking column and capable of coupling the jack frame with the jacking column to maintain the position of the jack frame relative to the jacking column.

Embodiment 21. The rotary chain jack of any of embodiments 15 to 20, wherein the hoist comprises a chainwheel and a chain coupled with the chainwheel.

Embodiment 22. A method of lifting a shiplift platform above a yard level of a shipyard, the method comprising: jacking-up a hoist, wherein the hoist is positioned adjacent the shiplift platform at the shipyard, wherein, during the jacking-up of the hoist, the hoist is decoupled from the shiplift platform, and wherein the jacking-up of the hoist comprises raising the hoist, relative to the yard level, from a first hoist height to a second hoist height; securing the hoist at the second hoist height; coupling the hoist, at the second hoist height, with the shiplift platform; with the hoist at the second hoist height and coupled with the shiplift platform, jacking-up the shiplift platform by raising the shiplift platform toward the hoist, from a first platform height to a second platform height; and securing the shiplift platform at the second platform height.

Embodiment 23. The method of embodiment 22, wherein the jacking-up of the hoist and the jacking-up of the shiplift platform are performed until the shiplift platform is raised above the yard level.

Embodiment 24. The method of any of embodiments 22 or 23, wherein the jacking-up is performed using a jack comprising an actuator coupled with a jack frame and coupled with a hoist frame of the hoist.

Embodiment 25. The method of embodiment 24, wherein the actuator is actuable into at least two positions including a first position and a second position, wherein in the first position the hoist frame and the jack frame are spaced apart by a first distance, wherein in the second position the hoist frame and the jack frame are spaced apart by a second distance, and wherein the second distance is greater than the first distance.

Embodiment 26. The method of embodiment 25, wherein the actuator is a linear actuator, wherein the first position is a retracted position of the linear actuator and the second position is an extended position of the linear actuator.

Embodiment 27. The method of embodiment 26, wherein the linear actuator is a hydraulic, pneumatic, or electric jack comprising a rod movably engaged within a cylinder, wherein one of the rod or the cylinder is coupled with the hoist frame, and wherein the other of the rod and the cylinder is coupled with the jack frame.

Embodiment 28. The method of any of embodiments 24 to 27, wherein the jack comprises a jacking column, and wherein the jacking-up comprises coupling the jacking column with the shipyard adjacent the hoist; wherein securing the hoist at the second hoist height comprises coupling the hoist frame with the jacking column to maintain a position of the hoist frame relative to the jacking column; and wherein securing the shiplift platform at the second platform height comprises coupling the jack frame with the jacking column to maintain a position of the jack frame relative to the jacking column.

Embodiment 29. The method of embodiment 28, wherein securing the hoist at the second hoist height comprises coupling jacking beams with both the hoist frame and the jacking column, and wherein securing the shiplift platform at the second platform height comprises coupling jacking beams with both the jack frame and with the jacking column.

Embodiment 30. The method of embodiment 27, wherein jacking-up the hoist comprises extending the rod to push the hoists upwards relative to the yard level, and wherein the jacking-up of the shiplift platform comprises retracting the rod to pull the shiplift upwards towards the hoists.

Embodiment 31. The method of any of embodiments 22 to 30, wherein, prior to jacking-up the hoist, the hoist is de-coupled from the shipyard.

Embodiment 32. The method of any of embodiments 22 to 31, wherein the shipyard comprises a plurality of hoists positioned adjacent the shiplift platform at the shipyard, and wherein each hoist comprises a hoist frame and a jack comprising an actuator coupled with a jack frame and coupled with a hoist frame of that hoist, the method comprising jacking-up the plurality of hoists relative to the yard level and jacking-up the shiplift platform by raising the shiplift platform toward the plurality of hoists.

Embodiment 33. The method of embodiment 32, wherein the plurality of hoists are jacked-up synchronously.

Embodiment 34. The method of any of embodiments 22 to 33, further comprising performing maintenance on the shiplift platform while the shiplift platform is raised above the yard level.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A shipyard, the shipyard comprising:

a yard, the yard defining a yard level;

a shiplift platform positioned adjacent the yard;

a lifting system comprising:

a chainwheel or winch capable of coupling with the shiplift platform and raising and lowering the shiplift platform relative to the yard level; and a jack, the jack comprising an actuator, wherein the actuator is actuable to move the chainwheel or winch between at least two positions, the at least two positions including a first position wherein the chainwheel or winch is positioned at a first height and is coupled with the yard and a second position wherein the chainwheel or winch is positioned at a second height and is decoupled from the yard and is raised above the yard level, wherein the second height is higher than the first height;

a jacking column; and a jacking beam, the jacking beam configured to couple with and between the chainwheel or winch and the jacking column to maintain the chainwheel or winch at the second height.

2. The shipyard of claim 1, wherein, in the first position, a frame of the chainwheel or winch and a frame of the jack are spaced apart by a first distance, wherein in the second position the frame of the chainwheel or winch and the frame of the jack are spaced apart by a second distance, and wherein the second distance is greater than the first distance.

3. The shipyard of claim 1, wherein the actuator is a linear actuator, wherein the first position is a retracted position of the linear actuator and the second position is an extended position of the linear actuator.

4. The shipyard of claim 3, wherein the linear actuator is a hydraulically actuated jack, pneumatically actuated jack, or electrically actuated jack, the linear actuator comprising a rod movably engaged within a cylinder, wherein the linear actuator is coupled with the chainwheel or winch and with the yard.

5. The shipyard of claim 1, wherein the jacking column is coupled with the yard and extends above the yard; and wherein a frame of the jack is capable of being coupled with the jacking column to maintain a position of the frame relative to the jacking column.

6. The shipyard of claim 5, wherein the jacking beams are capable of coupling the jack frame with the jacking column to maintain the position of the jack frame relative to the jacking column.

7. The shipyard of claim 1, wherein the lifting system is a rotary chain jack, the rotary chain jack comprising the chainwheel, a chain coupled with the chainwheel, wherein the chain is capable of being coupled with the shiplift platform.

8. The shipyard of claim 1, wherein the lifting system comprises the winch.

9. The shipyard of claim 8, wherein the jack is a separate structure from the winch.

10. A shiplift, the shiplift comprising:

a shiplift platform positioned adjacent a yard, the yard defining a yard level;

a chainwheel or winch capable of being coupled with the shiplift platform; and a linear actuator, wherein a first end of the linear actuator is coupled with the yard and a second end of the linear actuator is coupled with the chainwheel or winch;

wherein the linear actuator is actuable to move the chainwheel or winch between at least two positions, the at least two positions including a first position wherein the chainwheel or winch is positioned a first distance from the yard and a second position wherein the chainwheel or winch is positioned a second distance from the yard and is raised above the yard, wherein the second distance is greater than the first distance;

a jacking column; and a jacking beam, the jacking beam configured to couple with and between the chainwheel or winch and the jacking column to maintain a position of the chainwheel or winch.

11. A method of lifting a shiplift platform above a yard level of a shipyard, the method comprising:

jacking-up a hoist, wherein the hoist is positioned adjacent the shiplift platform at the shipyard, wherein, during the jacking-up of the hoist, the hoist is decoupled from the shiplift platform, and wherein the jacking-up of the hoist comprises raising the hoist, relative to the yard level, from a first hoist height to a second hoist height;

securing the hoist at the second hoist height;

coupling the hoist, at the second hoist height, with the shiplift platform;

with the hoist at the second hoist height and coupled with the shiplift platform, jacking-up the shiplift platform by raising the shiplift platform toward the hoist, from a first platform height to a second platform height; and securing the shiplift platform at the second platform height.

12. The method of claim 11, wherein the jacking-up of the hoist and the jacking-up of the shiplift platform are performed until the shiplift platform is raised above the yard level.

13. The method of claim 11, wherein the jacking-up is performed using a jack comprising an actuator coupled with a jack frame and coupled with a hoist frame of the hoist, wherein the actuator is actuable into at least two positions including a first position and a second position, wherein in the first position the hoist frame and the jack frame are spaced apart by a first distance, wherein in the second position the hoist frame and the jack frame are spaced apart by a second distance, and wherein the second distance is greater than the first distance.

14. The method of claim 13, wherein the actuator is a linear actuator, wherein the first position is a retracted position of the linear actuator and the second position is an extended position of the linear actuator, the jack comprising a rod movably engaged within a cylinder, wherein one of the rod or the cylinder is coupled with the hoist frame, and wherein the other of the rod and the cylinder is coupled with the jack frame, wherein jacking-up the hoist comprises extending the rod to push the hoists upwards relative to the yard level, and wherein the jacking-up of the shiplift platform comprises retracting the rod to pull the shiplift upwards towards the hoist.

15. The method of claim 13, wherein the jack comprises a jacking column, and wherein the jacking-up comprises coupling the jacking column with the shipyard adjacent the hoist; wherein securing the hoist at the second hoist height comprises coupling the hoist frame with the jacking column to maintain a position of the hoist frame relative to the jacking column; and wherein securing the shiplift platform at the second platform height comprises coupling the jack frame with the jacking column to maintain a position of the jack frame relative to the jacking column.

16. The method of claim 11, wherein, prior to jacking-up the hoist, the hoist is de-coupled from the shipyard.

17. The method of claim 11, wherein the shipyard comprises a plurality of hoists positioned adjacent the shiplift platform at the shipyard, and wherein each hoist comprises a hoist frame and a jack comprising an actuator coupled with a jack frame and coupled with a hoist frame of that hoist, the method comprising jacking-up the plurality of hoists relative to the yard level and jacking-up the shiplift platform by raising the shiplift platform toward the plurality of hoists.

18. The method of claim 17, wherein the plurality of hoists are jacked-up synchronously.

19. The method of claim 11, further comprising performing maintenance on the shiplift platform while the shiplift platform is raised above the yard level.

20. A shipyard, the shipyard comprising:

a yard, the yard defining a yard level;

a shiplift platform positioned adjacent the yard;

a chainwheel or winch; and a jack, the jack comprising an actuator;

wherein the chainwheel or winch is decoupled from the shiplift platform, and wherein the actuator is actuable to raise the decoupled chainwheel or winch, from a first height to a second height, relative to the yard level;

a jacking column; and a jacking beam, the jacking beam configured to couple with and between the chainwheel or winch and the jacking column and configured to maintain the chainwheel or winch at the second height.

21. A shipyard, the shipyard comprising:

a yard, the yard defining a yard level;

a shiplift platform positioned adjacent the yard;

a lifting system coupled with the yard, the lifting system comprising:

a hoist coupled with a hoist frame, wherein the hoist is capable of coupling with the shiplift platform and raising and lowering the shiplift platform relative to the yard level; and a jack, the jack comprising an actuator coupled with a jack frame and engaged with the hoist frame, wherein the actuator is actuable to raise the hoist above the yard level and is actuable to raise the shiplift platform above the yard level;

wherein the jack comprises a jacking column capable of being coupled with the yard; wherein, with the jacking column coupled with the yard, the hoist frame is capable of being coupled with the jacking column to maintain a position of the hoist frame relative to the jacking column; and wherein, with the jacking column coupled with the yard, the jack frame is capable of being coupled with the jacking column to maintain a position of the jack frame relative to the jacking column; and wherein the jack comprises jacking beams capable of coupling the hoist frame with the jacking column to maintain the position of the hoist relative to the jacking column and capable of coupling the jack frame with the jacking column to maintain the position of the jack frame relative to the jacking column.

22. A shiplift, the shiplift comprising:

a shiplift platform;

a hoist coupled with the shiplift platform;

a jack coupled with the hoist, wherein the jack is actuable to raise the hoist from a first height to a second height;

a jacking column; and a jacking beam, the jacking beam configured to couple with and between the hoist and the jacking column and to maintain the hoist at the second height.

* * * * *